US005667643A

United States Patent [19]

Satchell, Jr. et al.

[11] Patent Number: 5,667,643

[45] Date of Patent: Sep. 16, 1997

[54] HEAT EXCHANGER AND DOUBLE DISTILLATION COLUMN

[75] Inventors: Donald Prentice Satchell, Jr., Summit; Venkat Natarajan, Scotch Plains, both of N.J.; Richard Henry Clarke, Abingdon, United Kingdom

[73] Assignee: The BOC Group, Inc., New Providence, N.J.

[21] Appl. No.: 573,737

[22] Filed: Dec. 18, 1995

[51] Int. Cl.[6] ..... B01D 3/02

[52] U.S. Cl. ..... 202/154; 165/166; 62/643

[58] Field of Search ..... 202/154, 158, 202/264; 165/166, 914, 915, 140; 62/36, 42, 43

[56] References Cited

U.S. PATENT DOCUMENTS

| | | | |
|---|---|---|---|
| Re. 33,026 | 8/1989 | Petit et al. | 62/36 |
| 3,992,168 | 11/1976 | Toyama et al. | 62/42 |
| 4,372,818 | 2/1983 | Kaganovsy et al. | 202/83 |
| 4,599,097 | 7/1986 | Petit et al. | 62/36 |
| 5,354,428 | 10/1994 | Clark et al. | 202/154 |

*Primary Examiner*—Christopher Kim

*Attorney, Agent, or Firm*—David M. Rosenblum; Salvatore P. Pace

[57] ABSTRACT

A heat exchanger is provided which is suitable for use as a condenser/reboiler in a double distillation column. The heat exchanger has alternating first and second passages and a reservoir located above the first and second passages for receiving a first fluid and for containing a froth. A series of orifices can be provided by a distributor tray to provide flow communication between the reservoir and the first passages to allow at least a liquid phase of the froth to weep into the first passages and to be partly vaporized through indirect heat exchange with a second fluid flowing through the second passages. The partial vaporization produces a vapor phase of the froth which can at least in part escape from the orifices and interact with the first fluid to thereby form the froth. A remaining part of the liquid phase, not vaporized through the indirect heat exchange, is discharged from the bottom of the first passages into a sump. The weeping inlet of the liquid phase into the first passages allows for the automatic replenishment of the first passages due to flow mal-distribution.

16 Claims, 3 Drawing Sheets

HEAT EXCHANGER AND DOUBLE DISTILLATION COLUMN

BACKGROUND OF THE INVENTION

The present invention relates to a heat exchanger having application for service as a condenser/reboiler of a double distillation column. More particularly, the present invention relates to such a heat exchanger of the type known as a downflow reboiler or a falling film evaporator. Even more particularly, the present invention relates to such a heat exchanger in which a froth is created in a reservoir overlying heat exchange passages. Still even more particularly, the present invention relates to such a heat exchanger in which a liquid phase of the froth is distributed to the heat exchange passages through a distributor tray having orifices sized such that a liquid phase of the froth weeps into the heat exchange passages through the orifices to automatically replenish the heat exchange passages.

Downflow reboilers, also known as falling film evaporators, are used as a vehicle for indirectly transferring heat between a liquid and a vapor. Such heat exchangers are constructed from a plurality of parallel plates to form alternating heat exchange passages to indirectly exchange heat between two fluids such as liquid oxygen and gaseous nitrogen. Often, corrugated fin material is provided within the passages for liquid distribution and heat transfer purposes. Liquid and vapor are alternately distributed to the heat exchange passages so that a falling film of liquid in the liquid passages indirectly exchanges heat with vapor.

Such heat exchangers have application as condenser/reboilers in double distillation column systems. In a double distillation column, a multi-component mixture is fed into a higher pressure distillation column to produce a liquid column bottoms enriched in the higher boiling components and a vapor enriched in the lower boiling components. For instance, in case of low temperature rectification of air the higher boiling component is oxygen and the lower boiling component is nitrogen. The liquid column bottoms is further refined in a lower pressure column operatively associated with the higher pressure column by the condenser/reboiler. A liquid enriched in the higher boiling impurities collects in a sump of the lower pressure column. Reboiler feed produced through distillation in the lower pressure column and also enriched in the higher boiling components engages an indirect heat exchange with the vapor produced as tower overhead in the higher pressure column to vaporize part of the reboiler feed and to condense the vapor. The condensed vapor, in case of air separation, serves to reflux both the higher and lower pressure columns. The reboiler feed, not vaporized through the indirect heat exchange collects as the liquid column bottoms of the sump.

A problem addressed in many prior art designs of such heat exchangers is liquid mal-distribution occasioned by, for instance, leveling inaccuracy. In order to solve the liquid distribution problem, prior art heat exchangers employ distributors in which the liquid is distributed through an ever increasing complex array of openings. For instance in U.S. Pat. No. Re. 33,026, a rough distribution is made through relatively large and widely spaced holes. Thereafter, a finer distribution is made using packing. The problem with the foregoing prior art is that the holes can be easily plugged by solids and there is no self-correcting mechanism to eliminate dry areas. In other prior art heat exchanger designs, liquid distribution systems present a complicated mechanical structure. Installation difficulties further complicate the problem.

As will be discussed, the present invention provides a heat exchanger in which liquid is distributed by a mechanism that is less susceptible to prior art problems and is far simpler in design to liquid distribution systems of the prior art.

SUMMARY OF THE INVENTION

The present invention provides a heat exchanger for indirectly exchanging heat between a liquid and a vapor and for use with a sump. The heat exchanger comprises a plurality of first passages for receiving at least a liquid phase of a froth of a first fluid. A plurality of second passages are provided for receiving a second fluid. The first and second passages alternate with one an other in a heat transfer relationship to allow the liquid phase to partially vaporize and thereby to form a vapor phase of the froth through indirect heat exchange with the second fluid. The first passages are open at a bottom region of the heat exchanger to discharge at least a liquid resulting from a remaining part of the liquid phase, not vaporized through the indirect heat exchange, to the sump. An inlet and outlet means are provided for introducing and discharging the second fluid to and from the second passages. A reservoir is located above the first and second passages for receiving the first fluid and for containing the froth. An orifice means having orifices provides flow communication between the reservoir and the first passages so that at least part of the vapor phase of the froth flows through the orifices to the reservoir and interacts with the first fluid to form the froth. Each of the orifices have a weep point at which the at least liquid phase of the froth weeps into the second passages through the orifices. This "weeping action" thereby automatically replenishes the first passages with the liquid phase of the froth.

In another aspect, the present invention provides a double distillation column for rectifying a mixture containing higher and lower boiling components. In accordance with this aspect of the present invention higher and lower pressure columns are provided. A sump is provided to collect a liquid column bottoms enriched in the higher boiling components. The higher pressure column has a tower overhead region for collecting a vapor tower overhead enriched in the lower boiling components. At least one condenser/reboiler is located within the lower pressure distillation column to condense the vapor tower overhead against vaporizing a reboiler feed. The at least one condenser/reboiler comprises a plurality of first passages for receiving at least a liquid phase of a froth composed of the reboiler feed. A plurality of second passages are provided for receiving the vapor tower overhead. The first and second passages alternate with one an other in a heat transfer relationship to allow the liquid phase to partially vaporize and thereby to form a vapor phase of the froth through indirect heat exchange with the vapor tower overhead. The first passages are open at a bottom region of the heat exchanger to discharge at least the liquid column bottoms, composed of a remaining part of the liquid phase not vaporized through the indirect heat exchange, to the sump. An inlet and outlet means are provided for introducing the vapor tower overhead into the second passages find for discharging the condensed vapor tower overhead from the second passages, respectively. A reservoir is located above the first and second passages for receiving the reboiler feed and for containing the froth. An orifice means having orifices provides flow communication between the reservoir and the first passages so that at least part of the vapor phase of the froth flows through the orifices to the reservoir and interacts with the reboiler feed to form the froth. Each of the orifices has a weep point at which the at least liquid phase of the froth weeps into the second passages through the orifices. This "weeping action" thereby automatically replenishes the first passages with the liquid phase of the froth.

As will be discussed, the orifice means can be in the form of a distributor tray located within the reservoir. The distributor tray acts to form the froth. The froth has a substantially uniform depth and a substantially uniform equivalent dear liquid height from the liquid fed into the reservoir. Each opening in the distributor tray has a weep point which is a function of the froth clear liquid height and the vapor velocity of the vapor phase through the opening. If, due to a temporary mal-distribution, a channel has a relatively low vapor rate, then the liquid feed to that channel will increase or in other words, more liquid will tend to weep through the orifice into the liquid passage. At an extreme, if a channel completely dries out, froth will dump into the liquid passage. On the other hand, if a channel has a relatively high vapor flow rate, less liquid weeps into that channel. The liquid feed rate to each channel is controlled by the vapor flow rate from each channel and therefore, the distribution system of the present invention is self-sustaining.

Open area requirements for the distributor tray are also dictated by their use in passing both liquid and vapor. Large openings eliminate any solid plugging problems. A further advantage is that the heat exchanger can be employed so that vapor evolves from both of its ends to thereby reduce the overall pressure drop within the heat exchanger and to improve thermal performance over prior art designs.

BRIEF DESCRIPTION OF THE DRAWINGS

While the specification concludes with claims distinctly pointing out the subject matter that Applicants' regard as their invention, it is believed that the invention will be better understood when taken in connection with the accompanying drawings in which:

DETAILED DESCRIPTION

Figure 1:
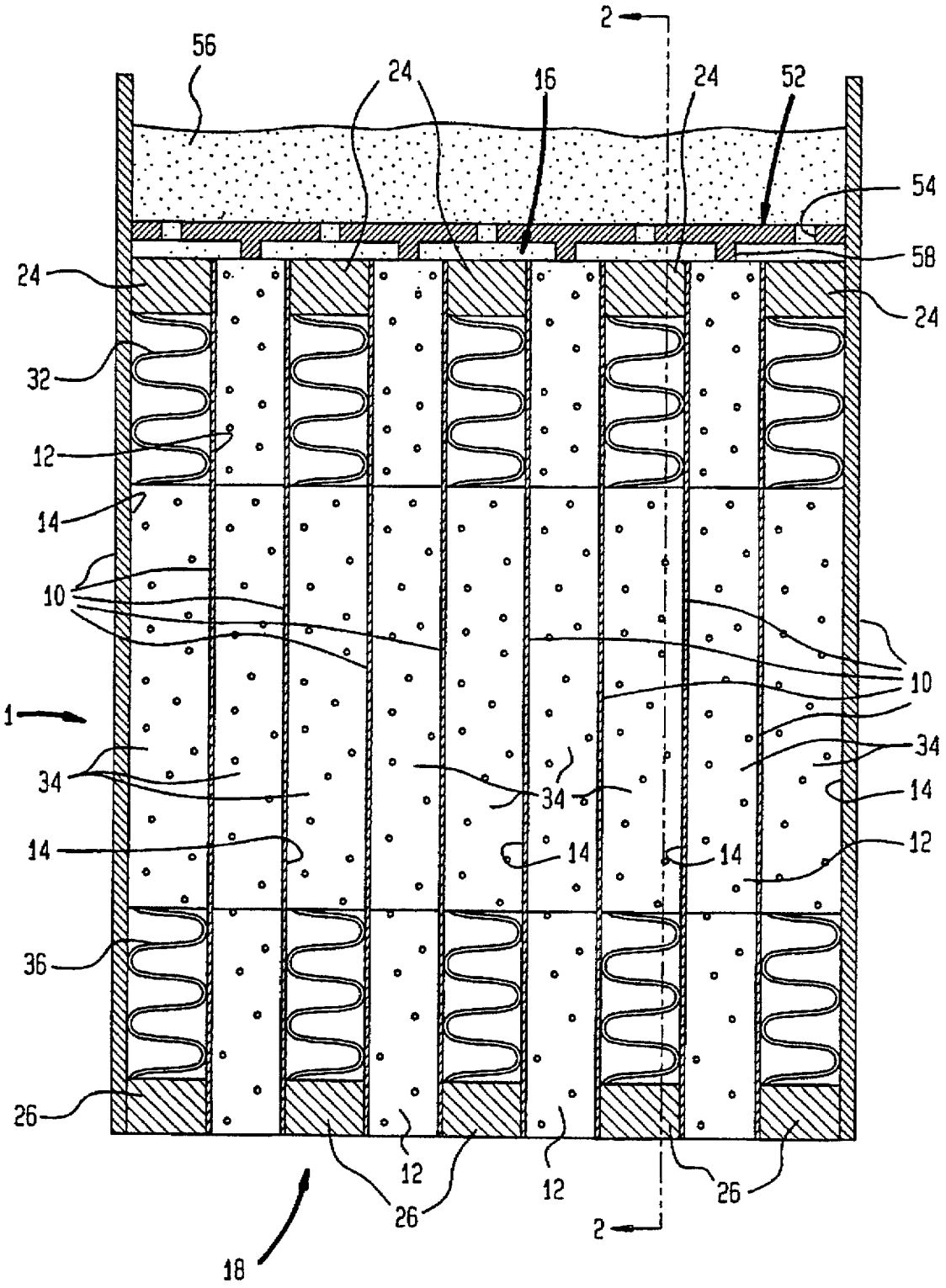
FIG. 1 is a sectional view of a heat exchanger in accordance with the present invention.

With reference to FIG. 1, a heat exchanger 1 of the present invention is illustrated. It is understood that heat exchanger 1 would function with a sump. As will be discussed the sump might be a sump of a lower pressure column of a double column distillation unit. Heat exchanger 1 could also be employed in a tank or pressure vessel in which the bottom of the tank or pressure vessel would function as the sump.

Figure 2:
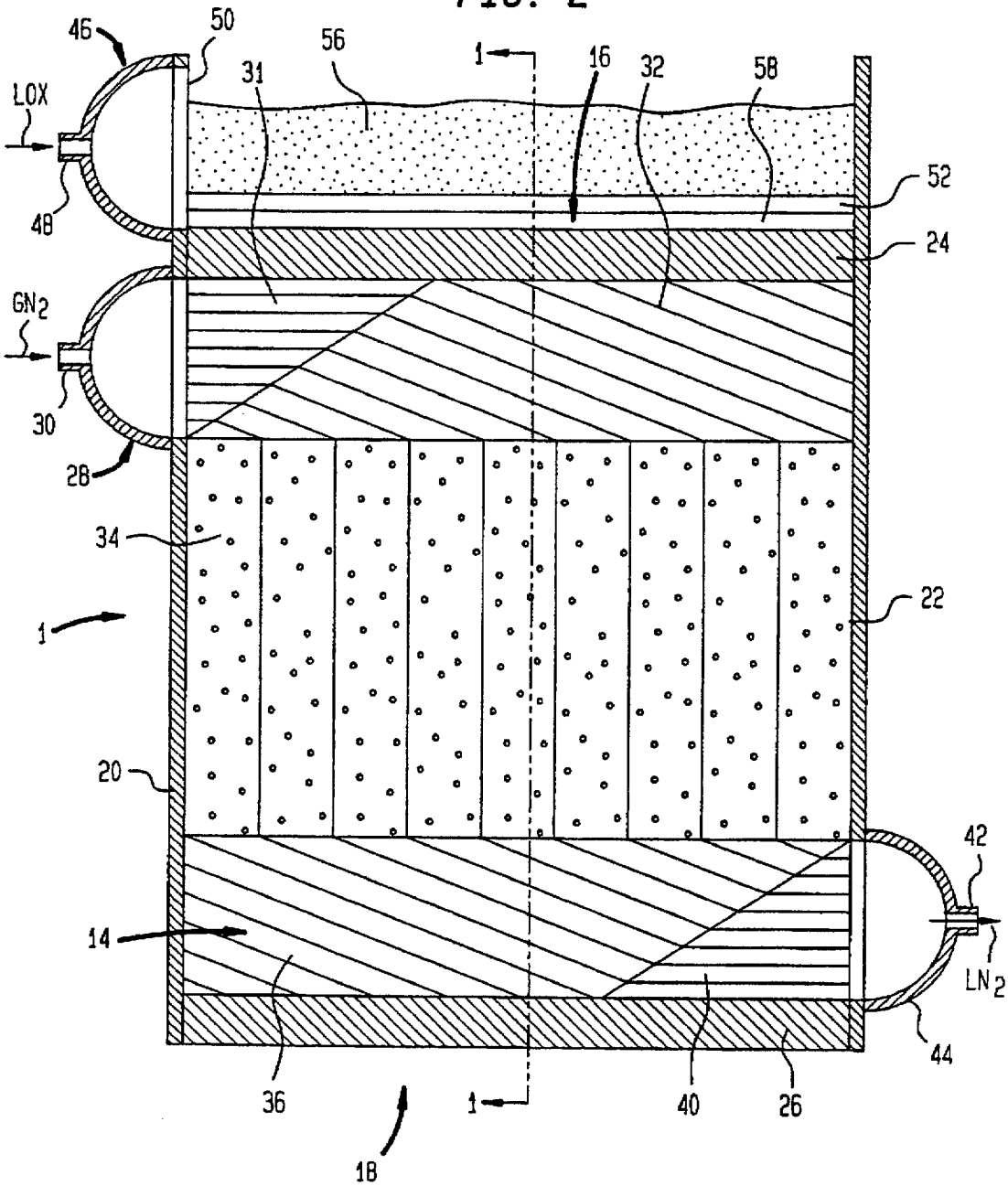
FIG. 2 is a sectional view of the heat exchanger in accordance with the present invention taken along line 2—2 of FIG. 1.

Heat exchanger 1 is formed by a plurality of plates 10 oriented in the vertical direction. The outermost of plates 10 are slightly thicker than plates 10 located between the outermost of plates 10 for structural supporting purposes. A plurality of alternating first and second passages, 12 and 14 are defined between plates 10 for effectuating indirect heat transfer between two fluids. With additionally reference to FIG. 2, plates 10 transversely connect side plates 20 and 22 to impart heat exchanger 1 with a box-like configuration. For purposes of explanation, it will be assumed that the two fluids are gaseous nitrogen to be condensed within heat exchanger 1 against the vaporization of liquid oxygen. However, it is understood that heat exchanger 1 might have other applications in which there is no change of state and the two fluids are other than atmospheric constituents.

Second passages 14 are sealed across top and bottom peripheral regions, designated by reference numerals 16 and 18, by provision of top and bottom sealing bars 24 and 26. An inlet manifold 28 having an inlet opening 30 is attached to side plate 20 for introduction of gaseous nitrogen into heat exchanger 1. Hardway corrugated fin material 31 is in communication with an inlet manifold 28 to conduct gaseous nitrogen to inclined corrugated fin material 32 which in turn acts to deflect gaseous nitrogen from its horizontal flow path through corrugated fin material 31 to a vertical flow path, through second passages 14. Second passages 14 (and first passages 12) contain corrugated fin material 34. Corrugated fin material 34 acts to increase the surface area available for heat transfer between nitrogen vapor and liquid oxygen. Liquid nitrogen produced by condensation of the gaseous nitrogen flows through inclined corrugated fin material 36 to deflect the liquid nitrogen from its vertical flow path to a horizontal flow path and into hardway corrugated fin material 40. The liquid nitrogen is discharged from heat exchanger 1 from a discharge opening 42 of an outlet manifold 44 connected to side plate 22.

Liquid oxygen enters an inlet manifold 46 through a manifold inlet 48 and is thereafter introduced into a liquid reservoir 50 that overlies first and second passages 12 and 14. A distributor tray 52 is located within reservoir 50 and above first and second passages 12 and 14. Distributor tray 52 is provided with slit-like orifices 54 to discharge a vapor phase of a froth 56 vaporized within first passages 12. The vapor phase passes through the incoming liquid oxygen within liquid reservoir 50 to form froth 56. Each of orifices 54 has a weep point at which froth 56 weeps into orifices 54 to automatically replenish first passages 12 with a liquid phase of froth 56. Assuming a mal-distribution of the liquid phase of froth 56 to any one of first passages 12, the resulting decay in the velocity of the evolved vapor phase passing through the associated orifice 54 will cause weeping of the liquid phase of froth 56 into such first passage 12.

Distributor tray 52 has legs 58 that rest on corrugated fin material 34 of first passages 12. This produces an offset of each orifice 54 so that (aside from orifice 54 located near side plates 20 and 22) two first passages 12 feed each orifice 54. Another possible embodiment is to construct distributor tray 52 with legs configured to be situated over nitrogen passages 14 so that orifices would be located directly over fast passages 12. As can be appreciated by those skilled in the art, other orifice configurations are possible such as circular openings. Additionally, in place of the illustrated distributor tray arrangement, orifices might be built into plates abutting or incorporated into top region 16 of heat exchanger 1.

As illustrated, first passages 12 are open at the bottom peripheral region 18 of heat exchanger 2, adjacent bottom spacer bars 26. As such, any portion of the liquid phase of froth 56 that is not vaporized will be discharged from bottom peripheral region 18 to a sump. Vapor of the vapor phase may also be discharged from bottom peripheral region 18 provided heat exchanger 1 is not submerged within liquid contained within the sump.

As can be appreciated by those skilled in the art, open area of distributor tray 52 and froth height are interrelated. As open area increases, froth height will decrease. Additionally, it should be mentioned that an increase in liquid flow or vapor velocity will increase froth height. A major factor in setting the froth height is that such height should be sufficient to permit the self-adjusting weeping function (described above) to operate in case of anticipated levelling tolerances. The inventors herein have found that a froth height of in a range of between about 5.08 cm. and about 30.48 cm. is an operable range that would allow heat exchanger 1 to function as a condenser/reboiler of a double distillation column unit designed fractionate air into nitrogen and oxygen rich fractions. Under such conditions of froth height, open area of slit-like orifices 54 will be within a range of between about 10% and about 40% of the total combined cross-sectional area of all of first passages 12. As an example of the foregoing, a heat exchanger 54 was designed with an open are of about 20% of the total combined cross-sectional area of all of first passages 12. When a liquid mass flux rate of about 20 $kg/m^2$-sec of oxygen was introduced into reservoir 50 and heat exchanger 1 was operated to vaporize about one-half of the incoming oxygen, a froth height of about 15.24 cm. resulted.

Although not illustrated, but as could be appreciated by those skilled in the art in any embodiment or application (including that of a condenser/reboiler to be discussed hereinafter) of heat exchanger 1, the liquid collected in the sump could be recirculated back to liquid reservoir 50 thereof. Alternatively, heat exchanger 1 could function as a "once-through" device in which liquid was not recirculated.

Figure 3:
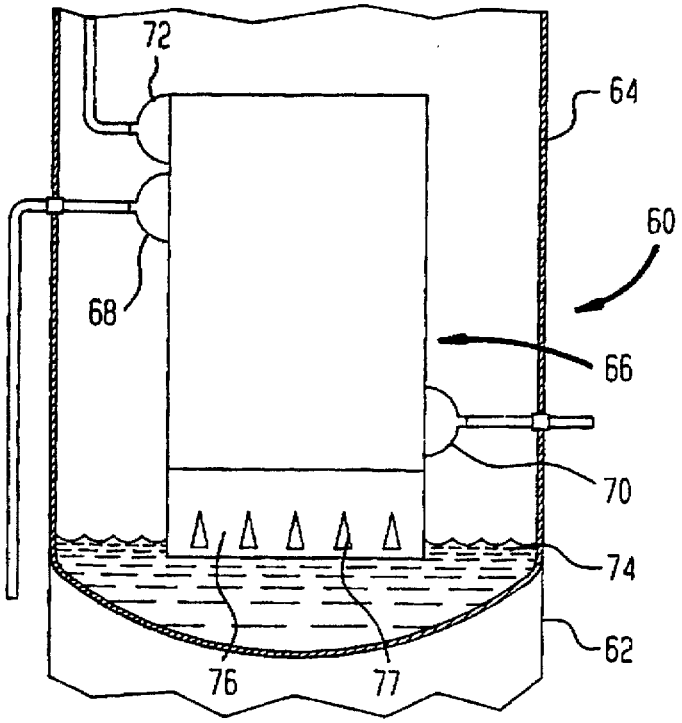
FIG. 3 is a schematic illustration of a double distillation column of the present invention.
Figure 4:
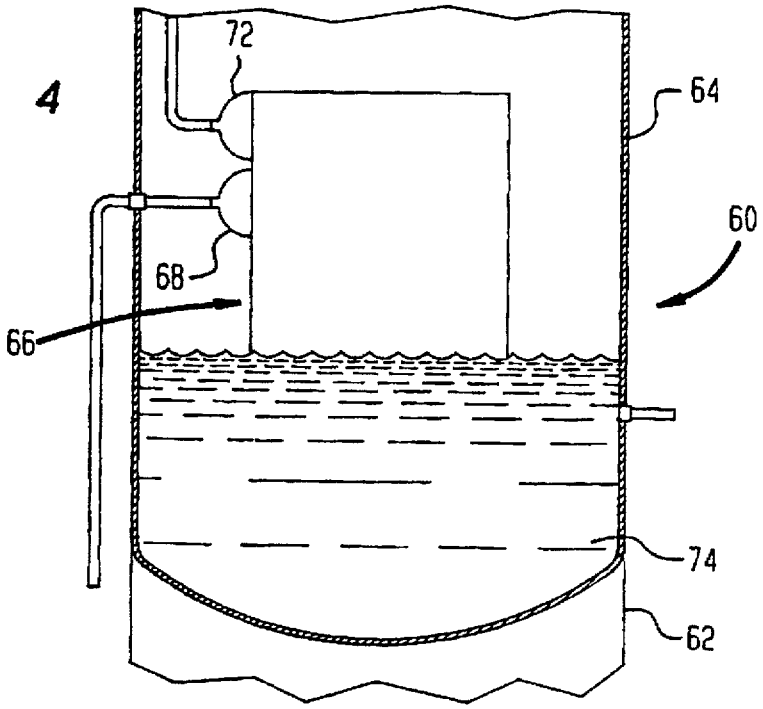
FIG. 4 is an alternative embodiment of a double distillation column of the present invention.

With reference to FIGS. 3 and 4, an air separation application is illustrated in which heat exchanger 1 serves as a condenser/reboiler of a double distillation column 60 having a higher pressure column 62 a lower pressure column 64. In the illustrated embodiment, a single condenser/reboiler 66 is illustrated having the same internal design as that illustrated for heat exchanger 1. As would be known to those skilled in the art, there could be multiple condenser/reboilers in condenser/reboiler applications of the present invention.

Condenser/reboiler 66 is provided with an inlet manifold 68 which is fed with nitrogen-rich vapor tower overhead from higher pressure column 62. The nitrogen-rich vapor tower overhead is condensed within condenser/reboiler 66 and the resultant liquid nitrogen is discharged from outlet manifold 70. The liquid nitrogen produced in such manner is used to reflux both the higher and lower pressure columns 62 and 64. Liquid oxygen is fed from the lowermost tray as reboiler feed through a liquid inlet manifold 72 of condenser/reboiler 66. The liquid phase of the froth oxygen not vaporized within condenser/reboiler 66 falls to a sump 74 as a liquid column bottoms of lower pressure column 64.

As illustrated (FIG. 3) condenser/reboiler 66 is spaced above sump 74 and is provided with an optional skirt 76 which extends into liquid column bottoms contained within sump 74. Apertures 77 are provided in skirt 76 to permit a portion of the vapor phase of the froth of condenser/reboiler 66 to be vented from the bottom thereof and to allow that portion of the liquid phase that is not vaporized within condenser/reboiler 66 to fall into sump 74. In the illustration, liquid column bottoms that would partly cover apertures 77 is removed in order to fully show apertures 77.

Under turn-down conditions of operation, less nitrogen vapor tower overhead will be introduced into condenser/reboiler 66 and thus, less of the reboiler feed will be vaporized. Under such circumstances, as the level of the liquid column bottoms within sump 74 rises, liquid column bottoms will progressively cover more of apertures 77 so that less of the vapor phase will be vented from openings 77. This will cause more of the vapor phase to flow through orifices of the distributor tray thereof to maintain froth height. It is to be noted that apertures 77 are given a triangular shape so that the apertures are particularly sensitive to an increase in liquid level. As could be appreciated, the aspect ratio of apertures 77 could be increased in order to be compatible with turbulence within sump 74. Other configurations of apertures 77 are possible. For instance, a plurality of parallel slits could be defined in skirt 76 to function in the manner of apertures 77. In such embodiment a greater or lesser percentage of such slits would be covered and uncovered to a rise and fall of liquid.

Skirt 76 could be deleted (FIG. 4) with the bottom region of condenser/reboiler 66 submerged within liquid oxygen. Furthermore condenser reboiler 66 might be situated so as to located above sump 74. A further point is that a skirt 76 could be used in connection with heat exchanger 1 when employed within a tank or other pressure vessel.

While the present invention has been described with reference to a preferred embodiment, as will occur to those skilled in the art, numerous changes, additions and omissions can be made without departing from the spirit and scope of the present invention.

What is claimed is:

1. A heat exchanger for indirectly exchanging heat between first and second fluids and for use with a sump, said heat exchanger comprising:

a plurality of first passages for receiving at least a liquid phase of a froth of a first fluid;

a plurality of second passages for receiving a second fluid;

said first and second passages alternating with one an other in a heat transfer relationship to allow said liquid phase of said froth to partially vaporize and thereby to form a vapor phase of said froth through indirect heat exchange with said second fluid;

said first passages being open at a bottom region of said heat exchanger to discharge at least a liquid resulting from a remaining part of said liquid phase, not vaporized through said indirect heat exchange, to said sump;

inlet and outlet means for introducing and discharging said second fluid to and from said second passages;

a reservoir located above said first and second passages for receiving said first fluid and for containing said froth; and orifice means for providing flow communication between said reservoir and said first passage so that at least part of said vapor phase of said froth flows through said orifices to said reservoir and interacts with said first fluid to form said froth;

each of said orifices having a weep point at which said at least said liquid phase of said froth weeps into said second passages through said orifices, thereby to automatically replenish said first passages with said liquid phase of said froth.

2. The heat exchanger of claim 1, wherein said orifice means comprises a distributor tray having a plurality of transversely oriented slots and legs supporting said distributor tray above said first and second passages.

3. The heat exchanger of claim 1, wherein said first and second passages contain corrugated fin material.

4. The heat exchanger of claim 1, wherein:

said orifice means comprises a distributor tray having a plurality of transversely oriented slots and legs supporting said distributor tray above said first and second passages;

said legs overlie said fast passages;

said first and second passages contain corrugated fin material; and said legs rest on said corrugated fin material.

5. The heat exchanger of claim 1 or claim 4, wherein said inlet means is located above said outlet means.

6. The heat exchanger of claim 1, further comprising a skirt depending from said bottom region of said heat exchanger to project into a level of said liquid located within said sump.

7. The heat exchanger of claim 6 wherein said skirt has a plurality of apertures configured such that a greater proportion of said vaporized liquid is discharged from said orifices as said level of said liquid rises within said sump.

8. The heat exchanger of claim 1 wherein said fast and second passages are defined between a plurality of vertically oriented, parallel plates.

9. A double distillation column for rectifying a mixture containing higher and lower boiling components, said double distillation column comprising:

a higher pressure column and a lower pressure column;

a sump to collect a columns bottom liquid enriched in said higher boiling components;

said higher pressure column having a tower overhead region for collecting a vapor tower overhead enriched in said lower boiling components; and at least one condenser/reboiler located within said bottom region of said lower pressure distillation column to condense said vapor tower overhead against vaporizing a reboiler feed, said at least one condenser/reboiler comprising:

a plurality of first passages for receiving at least a liquid phase of a froth composed of said reboiler feed;

a plurality of second passages for receiving said vapor tower overhead;

said first and second passages alternating with one an other in a heat transfer relationship to allow said liquid phase to partially vaporize and thereby to form a vapor phase of said froth through indirect heat exchange with vapor tower overhead;

said first passages being open at a bottom region of said heat exchanger to discharge at least said liquid column bottoms, composed of a remaining part of said liquid phase not vaporized through said indirect heat exchange, to said sump;

inlet and outlet means for introducing said vapor tower overhead into said second passages and for discharging condensed vapor tower overhead from said second passages, respectively;

a reservoir located above said first and second passages for receiving said reboiler feed and for containing said froth; and orifice means having orifices for providing flow communication between said reservoir and said first passages so that at least part of said vapor phase of said froth flows through said orifices to said reservoir and interacts with said reboiler feed to form said froth;

each of said orifices having a weep point at which said at least said liquid phase of said froth weeps into said first passages through said orifices, thereby to automatically replenish said first passages with said liquid phase of said froth.

10. The double distillation column of claim 9, wherein said orifice means comprises a distributor tray having a plurality of transversely oriented slots and legs supporting said distributor tray above said first and second passages.

11. The double distillation column of claim 10, wherein:

said first and second passages contain corrugated fin material; and said legs rest on said corrugated fin material.

12. The double distillation column of claim 11, wherein said inlet means is located above said outlet means.

13. The double distillation column of claim 9, wherein;

said sump is located within said lower pressure column; and said condenser/reboiler is positioned within said lower pressure column with its said bottom region located within said sump.

14. The double distillation column of claim 9, wherein:

said sump is located within said lower pressure column;

said condenser/reboiler is positioned within said lower pressure column; and said condenser/reboiler also has a skirt depending from said bottom region of said condenser/reboiler to project into a level of said liquid column bottoms located within said sump.

15. The double distillation column of claim 14 wherein said skirt has a plurality of apertures configured such that a greater proportion of said vapor phase is discharged from said orifices as said level of said liquid rises within said sump.

16. The double distillation column of claim 9, wherein said first and second passages are defined between a plurality of vertically oriented, parallel plates.

* * * * *